US011659895B2

(12) United States Patent
Gerig

(10) Patent No.: US 11,659,895 B2
(45) Date of Patent: May 30, 2023

(54) ARTICLE OF FOOTWEAR WITH ACCESSORY SYSTEM AND ACCESSORY KIT FOR AN ARTICLE OF FOOTWEAR

(71) Applicant: NIKE, Inc., Beaverton, OR (US)

(72) Inventor: Kristina Gerig, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 200 days.

(21) Appl. No.: 16/943,269

(22) Filed: Jul. 30, 2020

(65) Prior Publication Data

US 2021/0127791 A1 May 6, 2021

Related U.S. Application Data

(60) Provisional application No. 62/927,762, filed on Oct. 30, 2019.

(51) Int. Cl.

| | |
|---|---|
| ***A43B 23/24*** | (2006.01) |
| ***A43C 19/00*** | (2006.01) |
| ***A43D 8/16*** | (2006.01) |

(52) U.S. Cl.

CPC ..... *A43B 23/24* (2013.01); *A43C 19/00* (2013.01); *A43D 8/16* (2013.01)

(58) Field of Classification Search

CPC ..... A44C 15/009; A43D 8/16

USPC ..... 36/136, 100, 101, 112, 7.1 R; 2/245

See application file for complete search history.

(56) References Cited

U.S. PATENT DOCUMENTS

| | | | | |
|---|---|---|---|---|
| 294,186 | A * | 2/1884 | Beetle | A47G 25/92 24/40 |
| 2,082,309 | A * | 6/1937 | Turiansky | A43B 23/025 36/3 A |
| 4,026,047 | A | 5/1977 | Ahmer | |
| 5,136,726 | A * | 8/1992 | Kellin | A43B 23/24 2/310 |
| 5,946,823 | A | 9/1999 | Yates | |
| 6,769,204 | B1 * | 8/2004 | Phillips | A43B 3/0078 36/11.5 |
| 6,898,873 | B2 | 5/2005 | Schenone | |
| 7,107,707 | B2 | 9/2006 | Schenone | |

(Continued)

FOREIGN PATENT DOCUMENTS

| | | |
|---|---|---|
| BR | PI0601337 A | 12/2007 |
| CN | 201509724 U | 6/2010 |

(Continued)

*Primary Examiner* — Jameson D Collier
*Assistant Examiner* — Matthew R Marchewka
(74) *Attorney, Agent, or Firm* — Quinn IP Law

(57) ABSTRACT

An article of footwear may include an upper and a sole structure secured to the upper. The article of footwear may further include an accessory system that includes at least one ornamentation selectively securable to and removable from one or both of the upper or the sole structure. The one or more ornamentations may partially cover a contoured outer surface of the upper when secured to one or both of the upper or the sole structure but may be relatively flat when not secured to the upper or the sole structure. An accessory kit and a method of manufacturing the article of footwear includes securing first fastener components to the upper or sole structure and providing ornamentations with second fastener components releasably securable to the first fastener components and arranged in the same spatial arrangement when so secured.

19 Claims, 14 Drawing Sheets

(56) References Cited

U.S. PATENT DOCUMENTS 8,387,284 B2 3/2013 Baum
8,782,814 B2 7/2014 Schmelzer et al.
2002/0194750 A1 12/2002 Feick
2004/0093765 A1* 5/2004 Baldwin ..... A43D 999/00 36/11.5
2005/0016028 A1* 1/2005 Safdeye ..... A43B 3/0078 36/132
2005/0016032 A1* 1/2005 Cox ..... A43B 3/12 36/132
2006/0048408 A1* 3/2006 Spann ..... A43B 23/24 36/11.5
2006/0101673 A1* 5/2006 Robinson ..... A43B 23/0235 36/136
2006/0143951 A1* 7/2006 Yang ..... A43B 3/24 36/100
2006/0162193 A1 7/2006 Jones et al.
2007/0084019 A1* 4/2007 Wilcox ..... A43B 23/24 24/3.1
2009/0082180 A1* 3/2009 Castellano ..... A43B 7/38 36/136
2009/0183344 A1 7/2009 Polsky
2010/0107446 A1* 5/2010 Peet ..... A43B 23/24 36/100
2010/0115793 A1* 5/2010 Kraisosky ..... A43B 23/24 36/102
2010/0122474 A1* 5/2010 Wolf ..... A43B 3/0078 36/100
2010/0184349 A1 7/2010 Hernandez
2012/0137540 A1* 6/2012 Vattes ..... A43B 3/128 36/28
2012/0185996 A1 7/2012 Goldberg et al.
2013/0025164 A1 1/2013 Euresti et al.
2015/0257474 A1* 9/2015 Campbell ..... A43B 23/0295 36/101
2016/0255907 A1* 9/2016 Robison ..... A43C 19/00
2016/0345673 A1* 12/2016 Humphrey ..... A43C 19/00
2017/0231319 A1* 8/2017 Bohnsack ..... A43B 13/04 36/92
2018/0049495 A1 2/2018 Creason et al.
2019/0166952 A1* 6/2019 Vestuti ..... A43B 23/0265
2020/0205516 A1* 7/2020 Kilgore ..... A43B 3/0078
2020/0205520 A1* 7/2020 Kilgore ..... A43B 23/088

FOREIGN PATENT DOCUMENTS

KR 20110087726 A 8/2011
WO 2013048612 A1 7/2013

* cited by examiner

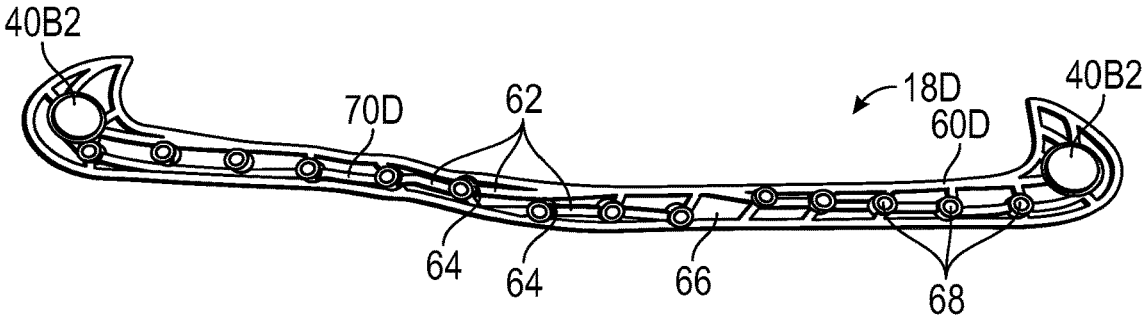
FIG. 9
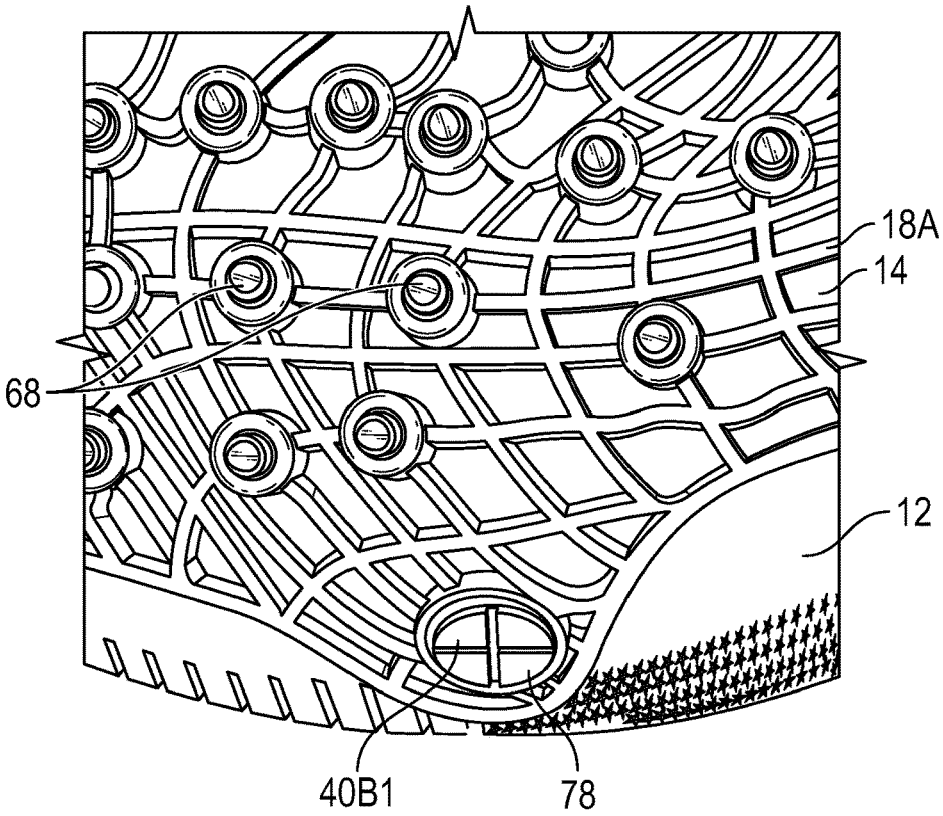
FIG. 10
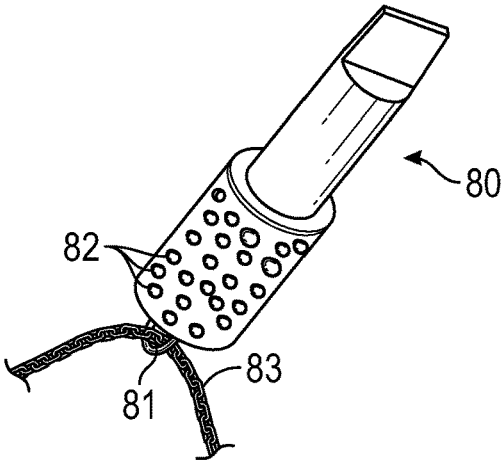

ARTICLE OF FOOTWEAR WITH ACCESSORY SYSTEM AND ACCESSORY KIT FOR AN ARTICLE OF FOOTWEAR

CROSS-REFERENCE TO RELATED APPLICATIONS

This application claims the benefit of priority to U.S. Provisional Application No. 62/927,762 filed Oct. 30, 2019, which is hereby incorporated by reference in its entirety.

TECHNICAL FIELD

The present disclosure generally relates to an article of footwear that includes an accessory system and to an accessory kit for an article of footwear.

BACKGROUND

Footwear typically includes an upper and a sole structure underlying and secured to the upper. An upper may have a specific material, color, or design for function, for aesthetic appearance, or both. Consumers may select footwear at least in part based on the aesthetic appearance of the footwear.

BRIEF DESCRIPTION OF THE DRAWINGS

The drawings described herein are for illustrative purposes only, are schematic in nature, and are intended to be exemplary rather than to limit the scope of the disclosure.

FIG. 9 is a plan view of a side ornamentation for medial and lateral sides of the article of footwear.

FIG. 10 is a fragmentary perspective view of the lateral side of the article of footwear in the forefoot region showing a fastener fixing the forefoot ornamentation to the article of footwear and a tool configured to fasten the fastener.

DESCRIPTION

Figure 1:
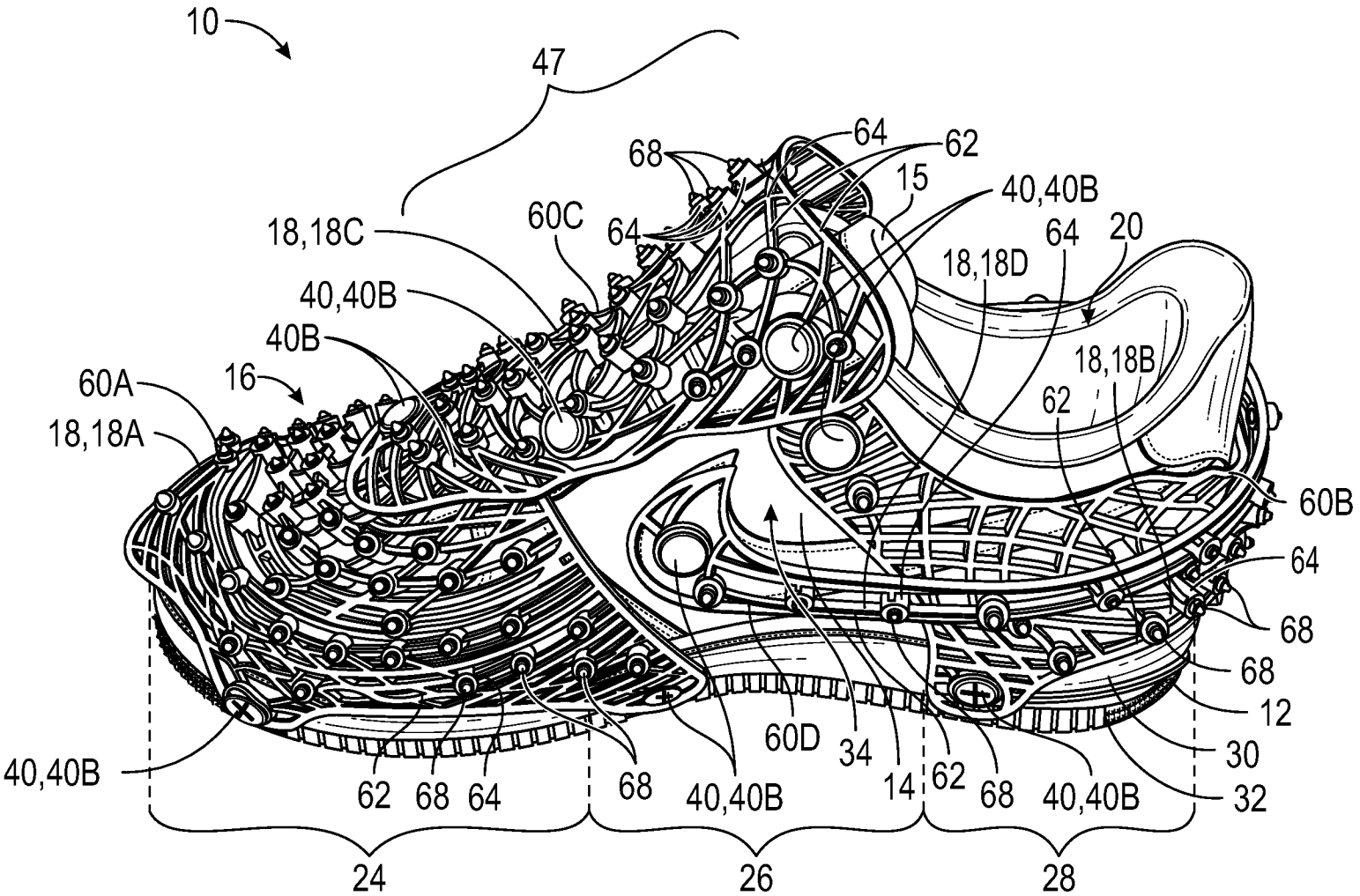
FIG. 1 is a perspective view of a medial side of an article of footwear including an accessory system.

The present disclosure generally relates to an article of footwear with an accessory system that allows the wearer to achieve a variety of aesthetic appearances of a single article of footwear.

The article of footwear may include an upper and a sole structure secured to the upper. The article of footwear may further include an accessory system that includes at least one ornamentation selectively securable to and removable from one or both of the upper or the sole structure. The one or more ornamentations may partially cover a contoured outer surface of the upper when secured to one or both of the upper or the sole structure but may be relatively flat when not secured to the upper or the sole structure. Stated differently, the ornamentations may flex from a relatively flat shape to a contoured shape when secured to the article of footwear, and the contoured shape may follow the contoured outer surface of the upper. Because each ornamentation is flexible to adapt from a relatively flat state when off of the upper and sole structure to the contoured shape when secured to one or both of the upper or the sole structure, the ornamentations are not limited in utility as ornamentations for footwear as they would likely be if they were rigidly formed with the contoured shape of the outer surface of the footwear rather than configured to be flexible from the flat state to the contoured shape. The shape and size of the ornamentation as well as the positioning of fasteners may further enable the ornamentation to be utilized as an ornamentation of the person rather than on the footwear as the ornamentation can flex to a different shape than when fastened to the upper and/or sole structure. For example, the ornamentation may be configured to be worn as a personal accessory when removed from the upper and sole structure, such as jewelry or a hair accessory. In some implementations, the ornamentation may be worn as a decorative bracelet or a headband. The owner of the footwear may decide to adorn the footwear with the ornamentation on some occasions and may decide to remove it from the footwear on other occasions, in which case it could be worn as another accessory on the person, for example. Accordingly, the one or more ornamentations may have different functions.

In an aspect, the at least one ornamentation includes a webbed base. For example, the webbed base may include a plurality of strands interconnected at nodes. The at least one ornamentation may further include embellishments secured to the webbed base at the nodes and exposed at an outer side of the webbed base. In an example, the webbed base may comprise a castable polyurethane. In another aspect, the embellishments may be beads. In some embodiments, the embellishments may comprise crystal, glass, or plastic.

The one or more ornamentations achieves flexibility (e.g., ability to adapt from a relatively flat state to the contoured surface of the footwear upper) due to the webbed base. Additionally, the webbed base reduces the overall weight of the ornamentation in comparison to an ornamentation with a solid base.

In order to secure the one or more ornamentations to the article of footwear, the accessory system may include a plurality of fasteners. The fasteners may include first fastener components fixed to the upper or the sole structure and second fastener components fixed to the at least one ornamentation and configured to removably secure to the first fastener components to secure the at least one ornamentation to the upper or the sole structure.

In an aspect, the first fastener components may be arranged in a first spatial arrangement on the upper or the sole structure and the second fastener components may be arranged in a second spatial arrangement on the at least one ornamentation. The second spatial arrangement may match the first spatial arrangement when the at least one ornamentation is disposed on the contoured outer surface of the upper.

In one example, a first set of the first fastener components may be fixed to the sole structure and a second set of the first fastener components may be fixed to the upper. The ornamentation may secure with fasteners of both of the first set and the second set such that it is secured to both the sole structure and the upper. In embodiments with more than one ornamentation, one of the ornamentations may secure with fasteners only to the upper or only to the sole structure. In some embodiments, a first group of the fasteners may be magnetic fasteners and a second group of the fasteners may be threaded fasteners. For example, at least one of the fasteners of the first group (e.g., the magnetic fasteners) may be secured to the upper along a foot opening defined by the upper. Magnetic fasteners may more quickly fasten and unfasten than threaded fasteners, so it may be advantageous to include magnetic fasteners along the foot opening to allow an ornamentation bordering the foot opening to be lifted in the event a wearer needs to widen the foot opening for foot insertion.

In one or more embodiments, the accessory system may further include a tool configured to fasten the second fastener components to the first fastener components. For example, if the fastener components are threaded fasteners, the tool may be a screw driver. The tool may include decorative aspects, such as embellishments that may match those of the ornamentation. The tool may be attached to a chain so that it may be worn as a necklace.

The at least one ornamentation may include multiple different ornamentations configured to adorn different portions of the upper. For example, the ornamentations may be selectively securable to and removable from one or both of the sole structure or the upper independently of one another, each partially covering a different respective contoured outer surface of the upper when secured to one or both of the sole structure or the upper, and at least some of the ornamentations having different shapes. In some embodiments, each of the ornamentations may include a webbed base, and the webbed base of at least one of the ornamentations may overlap the webbed base of at least one other of the ornamentations when the ornamentations are secured to one or both of the sole structure or the upper.

Some examples of the ornamentations may include an ornamentation that wraps from a medial side to a lateral side of the upper when secured to the upper or the sole structure, an ornamentation that adorns and contours to the forefoot region of the upper, an ornamentation that adorns and contours to the heel region of the upper, and an ornamentation that adorns and contours to a throat region of the upper.

An accessory kit for an article of footwear may include at least one ornamentation selectively securable to and removable from the article of footwear, the at least one ornamentation partially covering a contoured outer surface of an upper of the article of footwear when secured to the article of footwear. The at least one ornamentation may flex from a relatively flat shape to a contoured shape when secured to the article of footwear, the contoured shape following the contoured outer surface of the upper. In some embodiments, the accessory kit may include a tool configured to secure the at least one ornamentation to the article of footwear.

Different accessory kits may include one or more ornamentations having a different color, shape, or different embellishments, for example. Accordingly, an owner of the article of footwear could adorn the footwear with one or more ornamentations from a first accessory kit on one occasion, and adorn the footwear with one or more ornamentations from a second accessory kit on another occasion, the ornamentations of the second accessory kit having a different color, shape, different embellishments, etc. so that the appearance of the footwear on the second occasion is different than the appearance of the footwear on the first occasion.

A method of manufacturing an article of footwear may include providing an accessory system including at least one ornamentation selectively securable to and removable from one or both of a sole structure or an upper secured to the sole structure. The at least one ornamentation may partially cover a contoured outer surface of the upper when secured to the article of footwear. The at least one ornamentation may flex from a relatively flat shape to a contoured shape when secured to one or both of the sole structure or the upper, the contoured shape following the contoured outer surface of the upper.

In an aspect of the method, first fastener components may be arranged in a first spatial arrangement on one or both of a sole structure or a footwear upper, and the method may include securing a plurality of second fastener components to the at least one ornamentation so that the second fastener components are arranged in a second spatial arrangement matching the first spatial arrangement. Furthermore, the method may include securing the plurality of first fastener components to at least one of the footwear upper or the sole structure so that the first fastener components are arranged in the first spatial arrangement. The method may include providing a tool configured to fasten the second fastener components to the first fastener components.

The at least one ornamentation may include a webbed base with a plurality of strands interconnected at nodes, and the method may include securing embellishments to the webbed base at the nodes so that the embellishments are exposed at an outer side of the webbed base. The method may include casting the webbed base from a castable polyurethane.

The at least one ornamentation may be a first set of ornamentations, and the method may include providing a second set of ornamentations having second fastener components arranged in the second spatial arrangement and configured to removably secure to the first fastener components to secure the second set of ornamentations to the footwear upper or the sole structure. The second set of ornamentations may be different in at least one of a color, shape, or embellishments than the first set of ornamentations. For example, the kit may include both the first and second sets of ornamentations, or the first and second sets of ornamentations may be made available to a consumer for purchase separately, as different kits to adorn the footwear.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 is a medial side view of an article of footwear 10 that has a sole structure 12 and an upper 14 secured to the sole structure 12. The article of footwear 10 includes an accessory system 16 that has multiple ornamentations 18 (referred to individually as forefoot ornamentation 18A, heel ornamentation 18B, throat ornamentation 18C and side ornamentation 18D) shown selectively secured to the sole structure 12 and the upper 14 as further discussed herein.

The upper 14 forms a foot-receiving cavity 20 configured to receive a foot. The upper 14 may be a variety of materials, such as leather, textiles, polymers, cotton, foam, composites, etc., and is shown with a lace 22 (best viewed in FIG. 3) for tightening the upper 14 around a foot. The upper includes a tongue 15 shown in FIG. 1. The footwear 10 illustrated herein is depicted as an athletic shoe configured for sports or for wear as a leisure shoe, but the footwear 10 is not limited to athletic or leisure shoes. The footwear 10 including its components described herein may be an athletic shoe, a leisure shoe, a dress shoe, a work shoe, a sandal, a slipper, a boot, or any other category of footwear.

As indicated in FIG. 1, the footwear 10 may be divided into a forefoot region 24, a midfoot region 26, and a heel region 28, which are also the forefoot region, the midfoot region, and the heel region, respectively, of the sole structure 12 and the upper 14. The forefoot region 24 generally includes portions of the article of footwear 10 corresponding with the toes and the joints connecting the metatarsals with the phalanges. The midfoot region 26 generally includes portions of the article of footwear 10 corresponding with the arch area and instep of the foot, and the heel region 28 corresponds with rear portions of the foot, including the calcaneus bone. The forefoot region 24, the midfoot region 26, and the heel region 28 are not intended to demarcate precise areas of the footwear 10 but are instead intended to represent general areas of the footwear 10 to aid in the following discussion.

The sole structure 12 includes a midsole 30 and an outsole 32 which are integrated as a unitary component in the embodiment shown and may be referred to as a unisole. An insole (not shown) may rest on the sole structure 12 in the foot-receiving cavity 20. The midsole 30 attenuates ground reaction forces (e.g., provides cushioning) when compressed between the foot and the ground during walking, running, or other ambulatory activities. The outsole 32 establishes the ground-engaging surface of the article of footwear 10 and may be one-piece or may be several discrete outsole components. In one example, the outsole 32 may be formed from a wear-resistant material that may be textured to impart traction. For example, the outsole 32 may comprise a natural or synthetic rubber.

When the foot is positioned within the foot-receiving cavity 20 of the footwear 10, it is supported on a foot-facing surface of the midsole 30. The foot-facing surface of the midsole 30 may be covered by a strobel (not shown) secured to a lower region of the upper 14. Also, an insole (not shown) may rest on the strobel or directly on the sole structure 12 in embodiments without a strobel, in which case the foot is supported by both the sole structure 12 and the insole.

Figure 2:
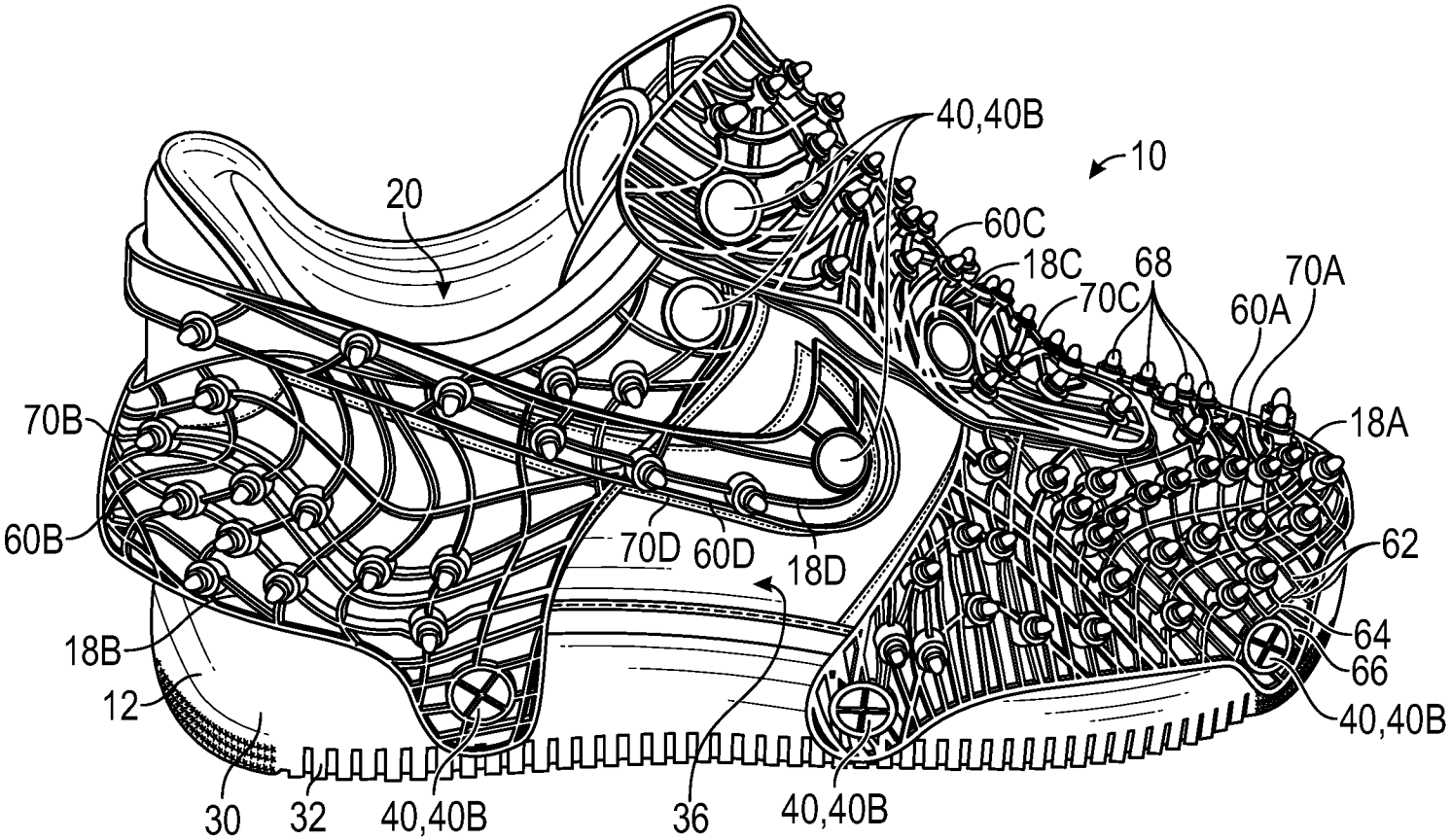
FIG. 2 is a perspective view of a lateral side of the article of footwear of FIG. 1.

The footwear 10 has a medial side 34 (shown in FIG. 1) and a lateral side 36 (best shown in FIG. 2). The medial side 34 and the lateral side 36 extend through each of the forefoot region 24, the midfoot region 26, and the heel region 28, each falling on an opposite side of a longitudinal midline (LM) of the article of footwear 10, as is understood by those skilled in the art. The medial side 34 is thus considered opposite to the lateral side 36.

Figure 3:
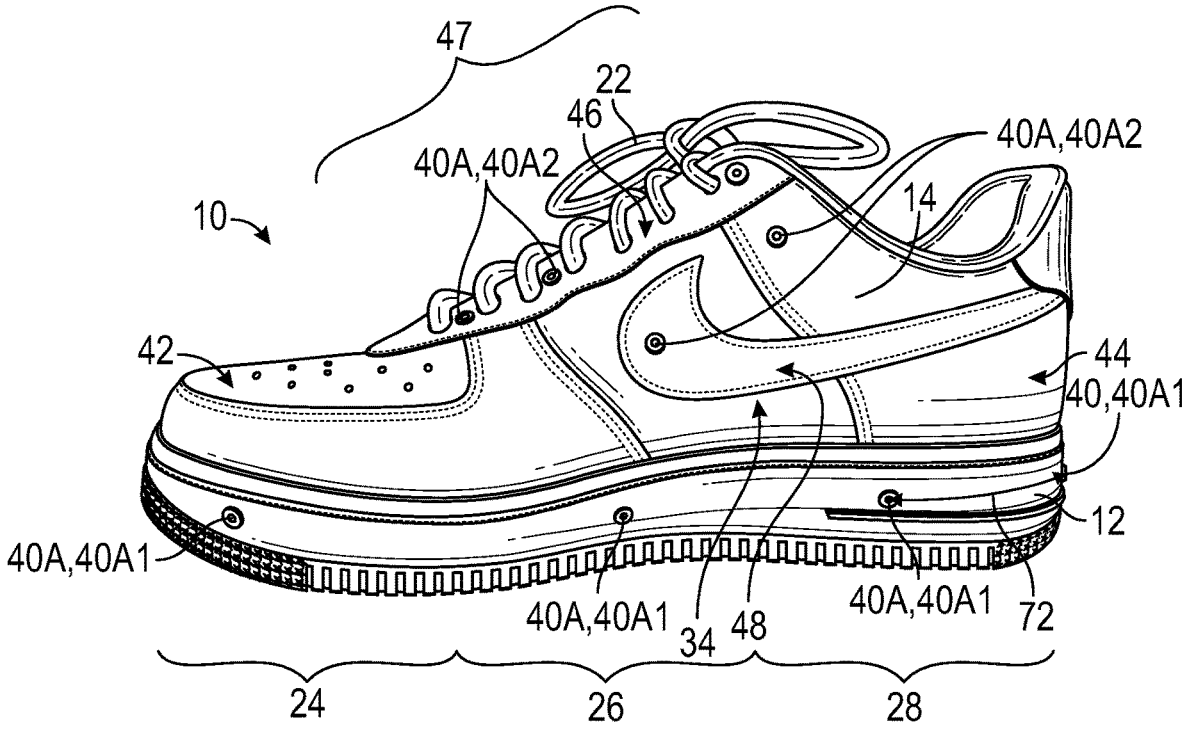
FIG. 3 is a perspective view of the medial side of the article of footwear of FIG. 1 with ornamentations of the accessory system removed.
Figure 4:
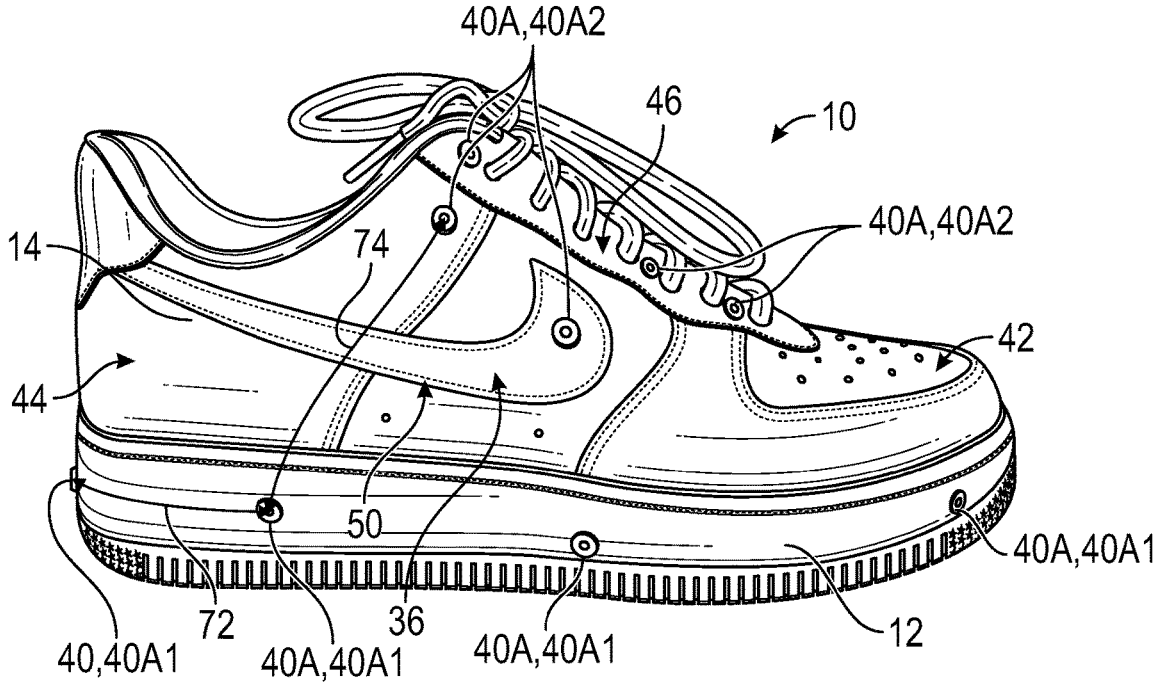
FIG. 4 is a perspective view of the lateral side of the article of footwear of FIG. 1 with ornamentations of the accessory system removed.

The ornamentations 18A-18D of the accessory system 16 are each selectively securable to and removable from one or both of the upper 14 or the sole structure 12 via fasteners 40. Each fastener 40 includes a first fastener component 40A and a second fastener component 40B. The first fastener components 40A are fixed to the upper 14 or to the sole structure 12 (e.g., in the embodiment shown, some of the first fastener components 40A are fixed to the upper 14 and some of the first fastener components 40A are fixed to the sole structure 12, as best shown in FIGS. 3 and 4). The second fastener components 40B are fixed to one of the ornamentation 18A-18D and configured to secure to one of the first fastener component 40A to secure the ornamentation 18A-18D to the upper 14 and/or the sole structure 12. The second fastener components 40B "removably" secure or couple or "releasably" secure or couple to the first fastening components 40A in that they are configured to be fastened and unfastened repeatedly during the typical useful life of the article of footwear. Stated differently, the second fastener components 40B may be selectively coupled to (e.g., fastened to) the first fastener components 40A to secure the ornamentations 18A-18D to the upper 14 and/or the sole structure 12 and may be selectively released (e.g., uncoupled or unfastened) from the first fastener components 40A to remove the ornamentations 18A-18D from the upper 14 and/or sole structure 12). For example, the fasteners 40 may be threaded fasteners, magnetic fasteners, or snaps. Although all of the ornamentations 18A-18D are shown secured to the upper 14 and/or the sole structure 12 in FIGS. 1 and 2, a wearer may choose to secure only one, two, or three of the ornamentations rather than all four to achieve and even greater variety of aesthetic appearances.

Each of the ornamentations 18A-18D partially covers a contoured outer surface of the upper 14 when secured to one or both of the upper 14 or the sole structure 12 but is relatively flat when not secured to the upper 14 or the sole structure 12. The ornamentation 18A may be referred to as a forefoot ornamentation. The forefoot ornamentation 18A adorns and contours to a contoured outer surface 42 (shown in FIGS. 3-5) of the upper 14 in the forefoot region 24 spanning, for example, from the medial side 34 to the lateral side 36. The ornamentation 18B may be referred to as a heel ornamentation. The heel ornamentation 18B adorns and contours to a contoured outer surface 44 (shown in FIGS. 3-5) of the upper 14 in the heel region 28 spanning, for example, from the medial side 34 to the lateral side 36. The ornamentation 18C may be referred to as a throat ornamentation and adorns and contours to a contoured outer surface 46 (shown in FIGS. 3-5) of a throat region 47 of the upper 14. The ornamentation 18D may be referred to as a side ornamentation and wraps from the medial side 34 to the lateral side 36 (around the back of the heel region 28) of the upper 14 when secured to the upper 14. The ornamentation 18D thus adorns and contours to the contoured outer surface 48 (see FIG. 3) at the medial side 34, the contoured outer surface 50 (see FIG. 4) at the lateral side 36, and the contoured outer surface 44 at the heel region 28. Accordingly, the different ornamentations 18A-18D are configured to adorn different portions of the upper 14. The ornamentations 18A-18D are selectively securable to and removable from one or both of the sole structure 12 and the upper 14 independently of one another via the fasteners 40 of each ornamentation 18A-18D.

Each ornamentation 18A-18D partially covers and follows a different respective contoured outer surface 42, 44, 46, 48, or 50 of the upper 14 when secured to one or both of the sole structure 12 or the upper 14. In order to do so, each of the ornamentations 18A-18D has a different shape when in a relatively flat state (shown in FIGS. 6-9) and can flexibly adapt from the relatively flat state to the contoured state (shown in FIGS. 1 and 2) when secured to the upper 14 and/or sole structure 12. Each ornamentation 18A-18D has a webbed base 60A-60D, respectively, as shown in FIGS. 1-2 and 6-9. The ornamentations 18A-18D achieve their flexibility (e.g., ability to adapt from a relatively flat state to a contoured shape that follows the contoured outer surface of the footwear upper 14) due to the webbed bases 60A-60D. Each webbed base 60A-60D includes a plurality of strands 62 interconnected at nodes 64. Spaces 66 exist between the strands 62, so each webbed base 60A-60D reduces the overall weight of the ornamentation 18A-18D in comparison to an ornamentation with a solid (unwebbed) base. The upper 14 is visible through the spaces 66 when the ornamentation 18A, 18B, 18C or 18D adorns the upper 14. The relatively thin and flexible strands 62 of the webbed bases 60A-60D enable the webbed bases 60A-60D to adapt to the contoured outer surfaces of the upper 14 and sole structure 12.

As best shown in FIGS. 1 and 2, the throat ornamentation 18C overlaps the forefoot and heel ornamentations 18A and 18B, and the side ornamentation 18D overlaps the heel ornamentation 18B when the ornamentations 18A-18D are secured to the sole structure 12 and/or the upper 14. More specifically, the webbed base 60C overlaps the webbed bases 60A and 60B and the webbed base 60D overlaps the webbed base 60B when the ornamentations 18A-18D are secured to the sole structure 12 and/or the upper 14 as discussed herein. The flexible nature of the ornamentations 18A-18D due to the flexible strands 62 enables overlap and contouring of the ornamentations 18A-18D to the contoured surfaces 42, 44, 46, 48, 50 of the upper 14 as discussed. The webbed base 60A-60D of each ornamentation 18A-18D may comprise a castable polyurethane configured as a flexible material to enable the functionality of the ornamentations 18A-18D as described.

Figure 16:
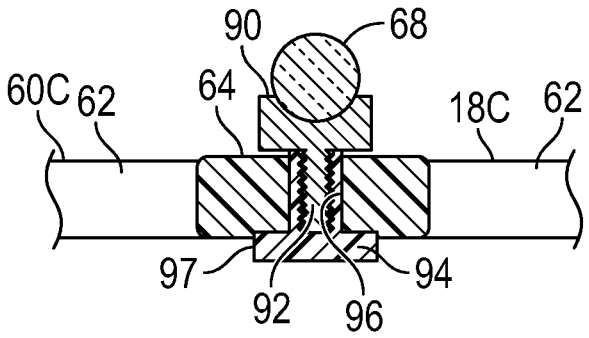
FIG. 16 is a fragmentary cross-sectional view of the ornamentation of FIG. 8 taken at lines 16-16 in FIG. 8.

The ornamentations 18A-18D include embellishments 68 secured to the webbed bases 60A-60D. The embellishments 68 are secured to an outer side 70A, 70B, 70C, and 70D, respectively, of the webbed bases 60A, 60B, 60C, and 60D at the nodes 64, but not all of the nodes 64 have an embellishment 68. Because they are secured to the outer sides 70A-70D, the embellishments 68 are visible at an exterior of the article of footwear 10 when the ornamentations 18A-18D are secured to the upper 14 and/or the sole structure 12. The embellishments 68 are shown as beads and may comprise crystal, glass, or plastic. As shown, the embellishments 68 are spherical beads as best shown in FIGS. 10 and 16. Alternatively, the embellishments 68 may have other shapes, could be faceted, may have different colors, etc.

Figure 5:
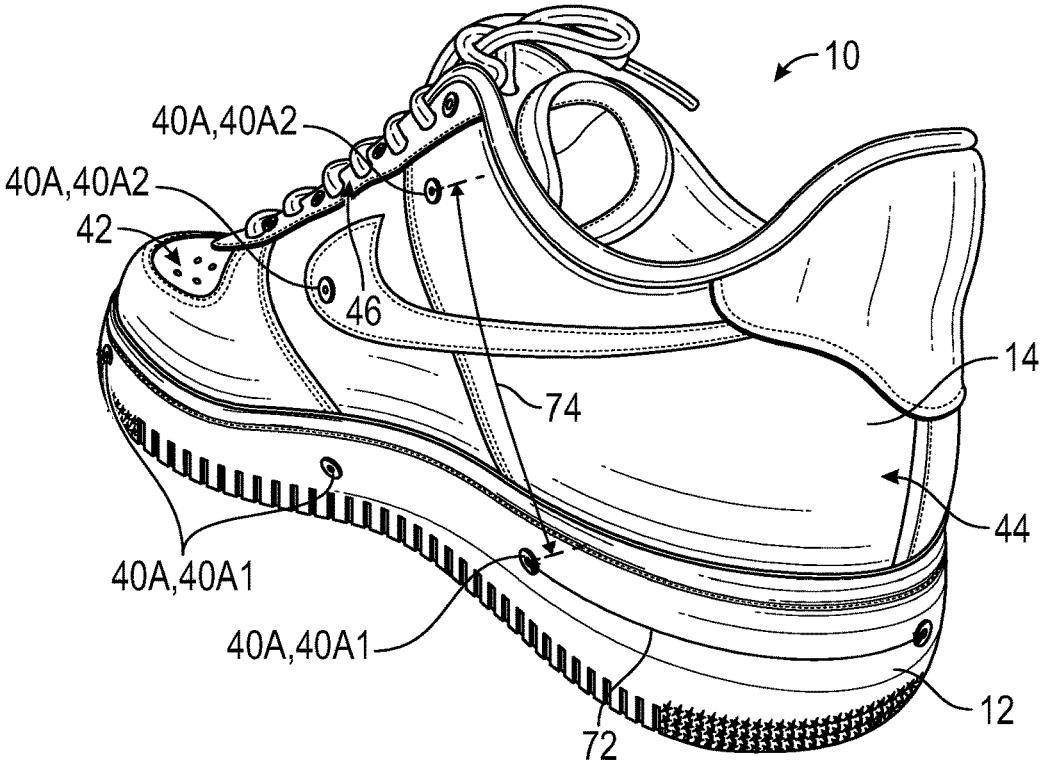
FIG. 5 is a rear perspective view of the medial side of the article of footwear of FIG. 1 with ornamentations of the accessory system removed.
Figure 6:
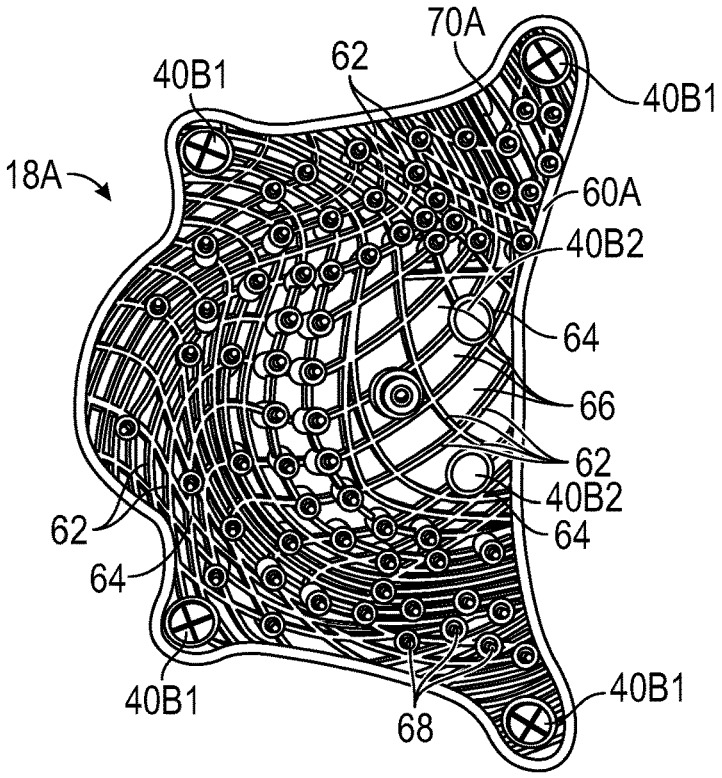
FIG. 6 is a plan view of a forefoot ornamentation for the forefoot region of the article of footwear.
Figure 7:
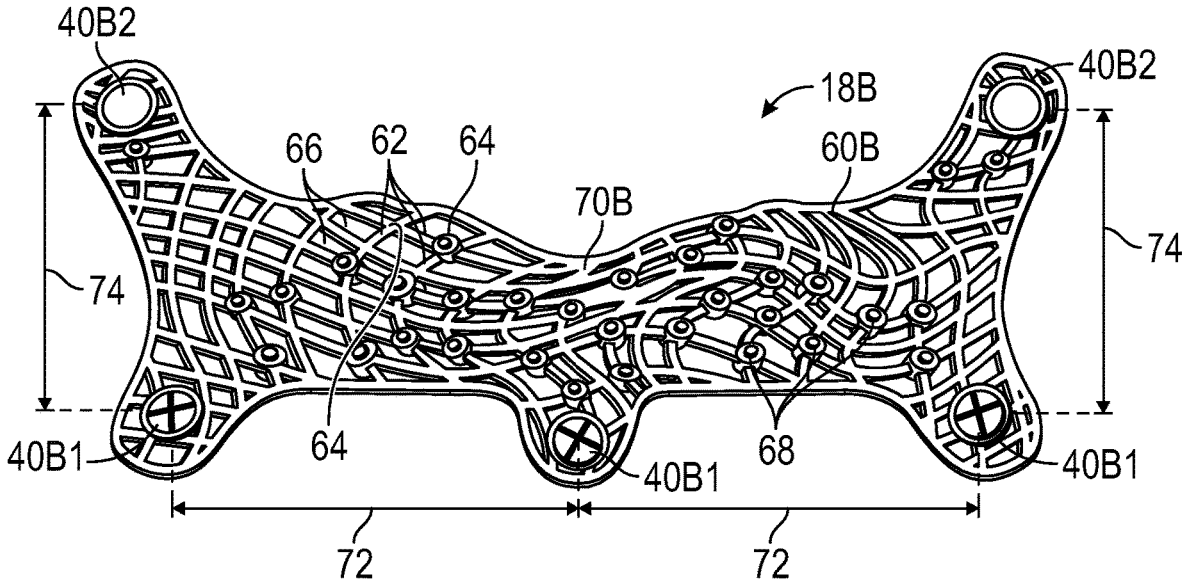
FIG. 7 is a plan view of a heel ornamentation for the heel region of the article of footwear.

As shown in FIGS. 3-5, a first set 40A1 of the first fastener components 40 are fixed to the sole structure 12 and a second set 40A2 of the first fastener components 40 are fixed to the upper 14. The forefoot ornamentation 18A includes four second fastener components 40B (marked as 40B1 in FIG. 6) that secure to first fastener components 40 of the first set 40A1 (e.g., to secure the forefoot ornamentation 18A to the sole structure 12) and two second fastener components 40B (marked as to 40B2 in FIG. 6) that secure to first fastener components 40 of the second set 40A2 (e.g., to secure the forefoot ornamentation 18A to the upper 14). The second fastener components 40B2 of the forefoot ornamentation 18A are covered by the overlapping throat ornamentation 18C in FIGS. 1 and 2 and are thus obscured from view. Accordingly, the forefoot ornamentation 18A is releasably securable to both the sole structure 12 and the upper 14.

The heel ornamentation 18B includes three second fastener components 40B (marked as 40B1 in FIG. 7) that secure to first fastener components 40 of the first set 40A1 (e.g., to secure the forefoot ornamentation 18A to the sole structure 12) and two second fastener components 40B (marked as to 40B2 in FIG. 7) that secure to first fastener components 40 of the second set 40A2 (e.g., to secure the heel ornamentation 18B to the upper 14). Accordingly, the heel ornamentation 18B is releasably securable to both the sole structure 12 and the upper 14.

The throat ornamentation 18C includes five second fastener components 40B (marked as to 40B2 in FIG. 8) that secure to first fastener components 40 of the second set 40A2 (e.g., to secure the throat ornamentation 18C to the upper 14). The throat ornamentation 18C is releasably secured only to the upper 14 and has no fastener components securing the throat ornamentation 18C to the sole structure 12.

The side ornamentation 18D includes two second fastener components 40B (marked as to 40B2 in FIG. 9) that secure to first fastener components 40 of the second set 40A2 (e.g., to secure the side ornamentation 18D to the upper 14). The side ornamentation 18D is releasably secured only to the upper 14 and has no fastener components securing the side ornamentation 18D to the sole structure 12.

In an aspect, the respective first fastener components 40A to which one of the ornamentations 18A-18D releasably secures may be arranged in a first spatial arrangement on the upper 14 and/or the sole structure 12 and the second fastener components 40B may be arranged in a second spatial arrangement on the ornamentation (e.g., when the ornamentation is in the flat state), the second spatial arrangement matching the first spatial arrangement when the ornamentation is disposed on the contoured outer surface of the upper 14 and/or sole structure 12. For example, in the flat state of FIG. 7, centers of adjacent ones of the three second fastener components 40B1 of the heel ornamentation 18B are spaced apart by a first distance 72 and centers of the second fastener components 40B2 are spaced apart from adjacent first fastener components 40A1 by a second distance 74. This may be referred to as a second spatial arrangement. As shown in FIGS. 3-5, the first fastener components 40A1 and 40A2 to which the second fastener components 40B1 and 40B2 of the heel ornamentation 18B are secured in FIGS. 1 and 2 are in a first spatial arrangement with the same spacing between centers of the fastener components. The remaining ornamentations 18B, 18C, and 18D also have spatial arrangements that match the spatial arrangements of the fastener components 40A1, 40A2 of the upper 14 and/or sole structure 12 to which they secure. Due to the matching spatial arrangements, the ornamentations 18A-18D secure to the upper 14 and or the sole structure 12 at the first fastener components 40A shown in FIGS. 3-5 in the orientations shown in FIGS. 1 and 2 without any stretching or straining of the ornamentations 18A-18D.

Figure 11:
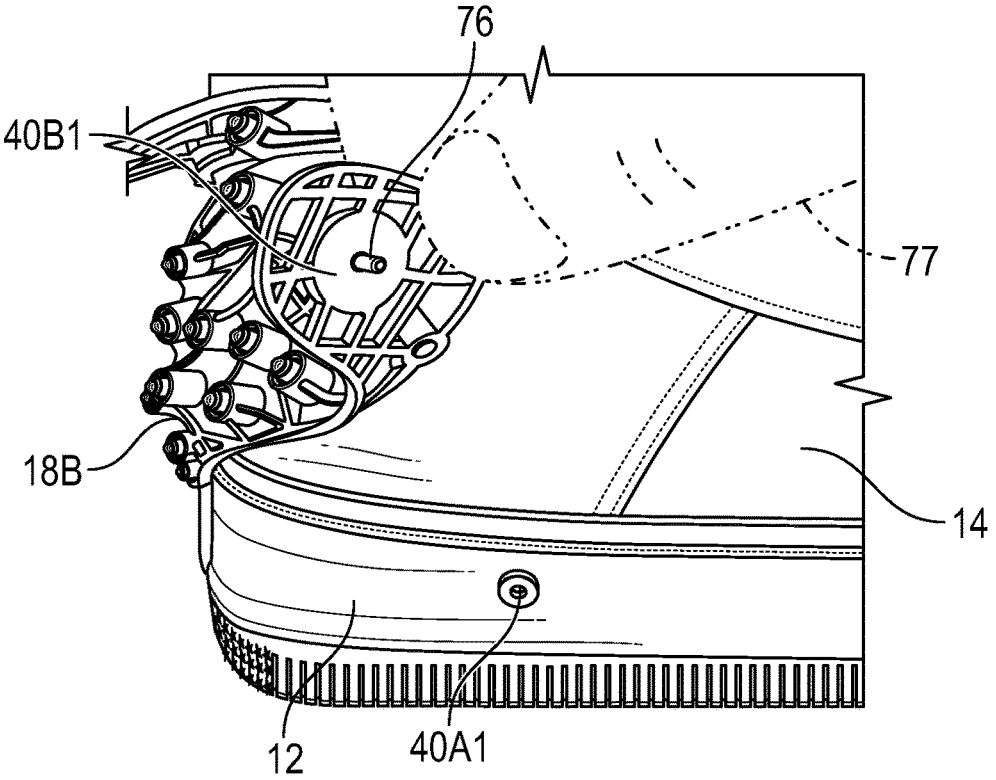
FIG. 11 is a fragmentary plan view of the lateral side of the article of footwear in the heel region showing another fastener like that of FIG. 10 with the heel ornamentation lifted and in an unfixed state.
Figure 15:
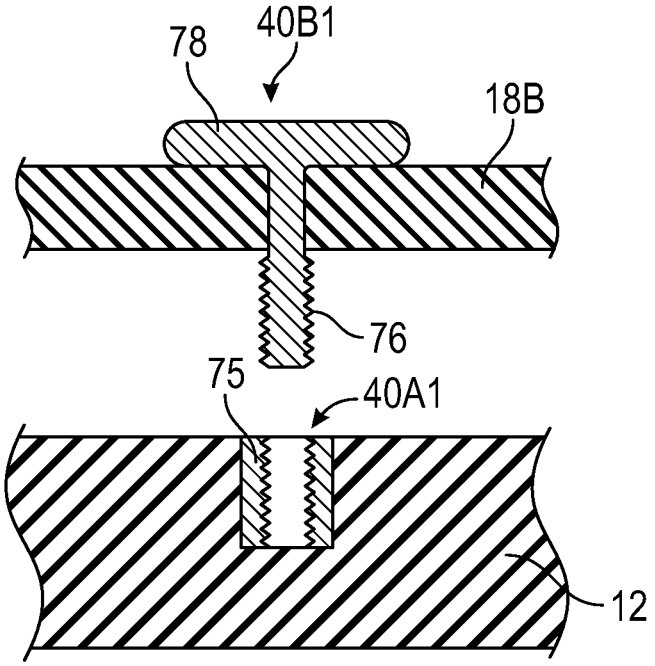
FIG. 15 is a fragmentary exploded cross-sectional view of the heel ornamentation and the sole structure of FIG. 11 with the fastener in an unfastened state.

In some embodiments, a first group of the fasteners 40 may be magnetic fasteners or snaps, and a second group of the fasteners 40 may be threaded fasteners. For example, FIGS. 10, 11 and 15 show fasteners 40 of the second group (e.g., threaded fasteners). A first fastener component 40A1 of each threaded fastener 40 includes an internally threaded housing 75 recessed into the sidewall of the sole structure 12 (shown in FIGS. 3-5 and 11). A second fastener component 40B1 of each threaded fastener 40 of the second group includes a threaded stud 76 extending from a head 78 (see, e.g., FIGS. 11 and 15). The threaded stud 76 is configured with threads matable to the internal threads of the internally threaded housing 75. In FIG. 11, the heel ornamentation 18B is lifted by a hand 77 and in an unfixed state to show the threaded stud 76. In the drawings, the fasteners 40 of the second group include fastener components with a head configured to be driven by a screw (e.g., a head with a Phillips pattern as shown).

The accessory system 16 includes a tool 80 (see FIG. 10) configured to fasten the second fastener components 40B1 of the second group (e.g., the threaded fasteners 40) to the first fastener components 40A1. For example, the tool 80 is shown as a screw driver configured to mate with the head 78 to drive the second fastener component 40B1 to tighten or loosen relative to the first fastener component 40A1. The tool 80 has decorative aspects, such as embellishments 82, that may be similar to the embellishments 68 of the ornamentations 18A-18B. The tool 80 is shown with a loop 81 through which a chain 83 may be received so that the tool 80 is attached to the chain 83 and may be worn as a necklace in order to keep the tool 80 with the customer, readily available for tightening or loosening the fasteners 40 to secure or remove any of the ornamentations 18A-18B, 118A-118D, or 218A discussed herein.

Figure 12:
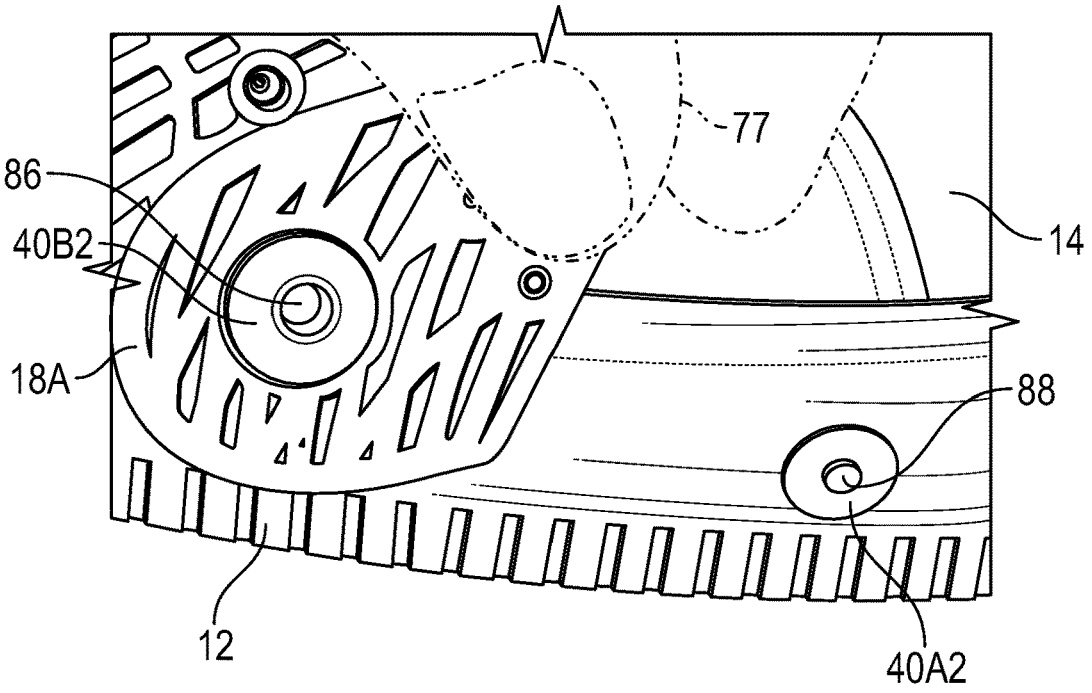
FIG. 12 is a fragmentary perspective view of the medial side of the article of footwear in the forefoot region showing an alternative fastener with the forefoot ornamentation lifted and in an unfixed state.
Figure 13:
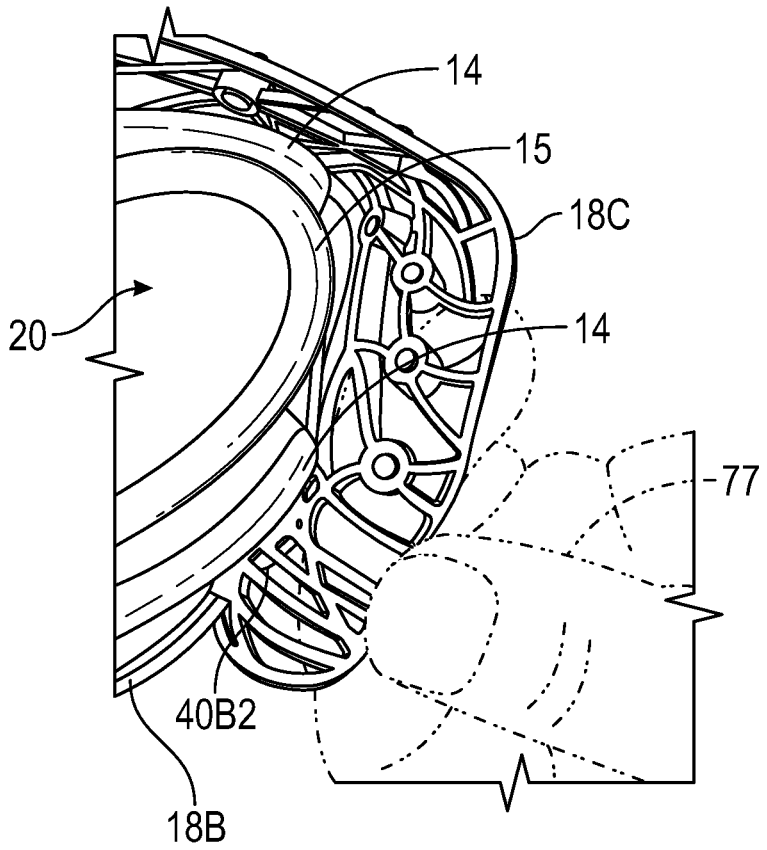
FIG. 13 is a fragmentary view of the throat region of the article of footwear with the throat ornamentation lifted and in an unfixed state.
Figure 14:
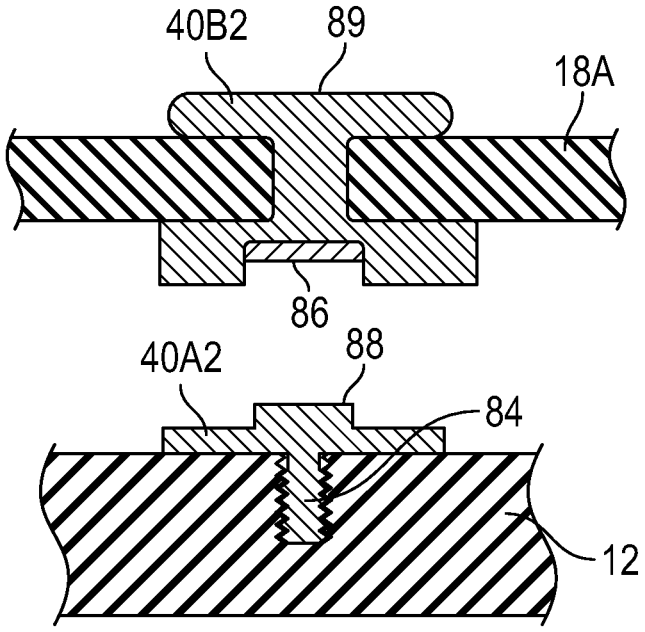
FIG. 14 is a fragmentary exploded cross-sectional view of the forefoot ornamentation and the sole structure of FIG. 12 with the fastener in an unfastened state.

FIGS. 12-14 show fasteners 40 of the first group (e.g., magnetic fasteners). In the drawings, the fasteners 40 of the first group include second fastener components having a head without a screw drive pattern on the head. FIG. 14 shows one of the fasteners 40 with a first fastener component 40A2 secured to the sole structure 12 with a threaded stud 84. The second fastener component 40B2 includes a magnet 86 disposed at an inner side of the forefoot ornamentation 18A. An exposed face of the first fastener component 40A2 includes a material 88 to which the magnet 86 releasably couples. Alternatively, a magnet could be disposed on the second fastener component 40B2 with a material attracted to the magnet on the first fastener component 40A2. FIG. 13 shows the throat ornamentation 18C being pulled back away from the upper 14 to enable the upper 14 to be stretched to widen the foot-receiving cavity 20 such as just prior to foot insertion. Second fastener components 40B2 of the throat ornamentation 18C and of the heel ornamentation 18B bordering the foot-receiving cavity 20 are magnetic fasteners like that of FIG. 14 as these may more quickly fasten and unfasten without the use of a tool (e.g., second fastener component 40B2 unfastens from first fastener component 40A2 faster than the threaded fasteners having first and second fastener components 40A1, 40B1).

Figure 22:
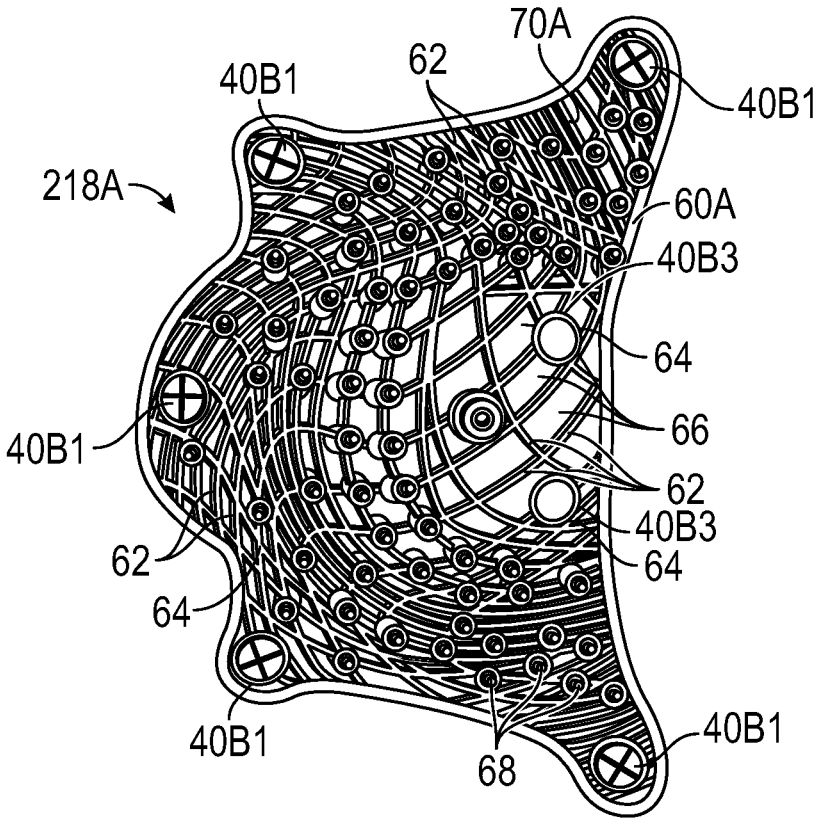
FIG. 22 is a plan view of an alternative forefoot ornamentation for the forefoot region of an article of footwear.
Figure 23:
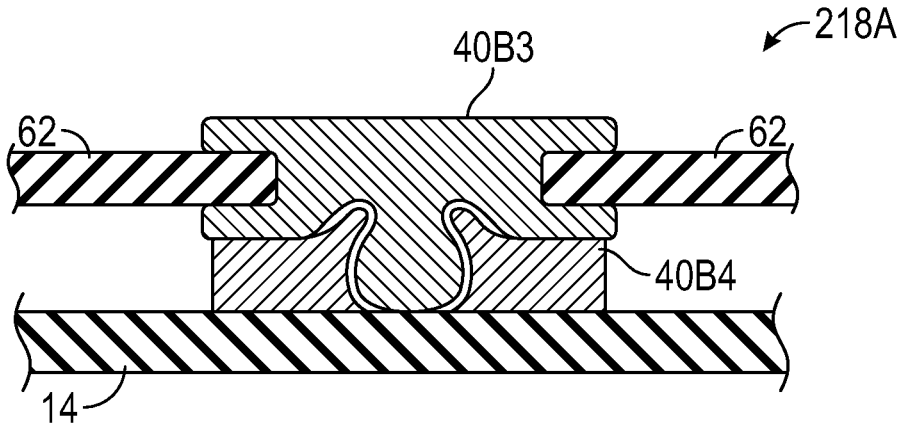
FIG. 23 is a cross-sectional view of an article of footwear with a fastener of the forefoot ornamentation of FIG. 22 in a fastened state.

FIG. 22 shows an alternative embodiment of a forefoot ornamentation 218A in which some of the fasteners are snaps instead of magnetic fasteners. A second fastener component 40B3 of the first group is a head of the snap and a second fastener component 40B4 shown in FIG. 23 secured to the upper has a recess that receives the head. An additional fastener component 40B1 is also included on the webbed base of the forefoot ornamentation 218A and is configured to be disposed at a foremost extent of the sole structure 12, which would have a fastener component 40A1 like those shown in FIG. 5. Accordingly, it may be advantageous to include magnetic fasteners like those of FIG. 14 or snaps like those of FIGS. 22 and 23 along the foot opening defined by the upper 14 into the foot-receiving cavity 20 to allow any ornamentation bordering the foot opening to be lifted in the event a wearer needs to widen the foot opening for foot insertion.

Figure 8:
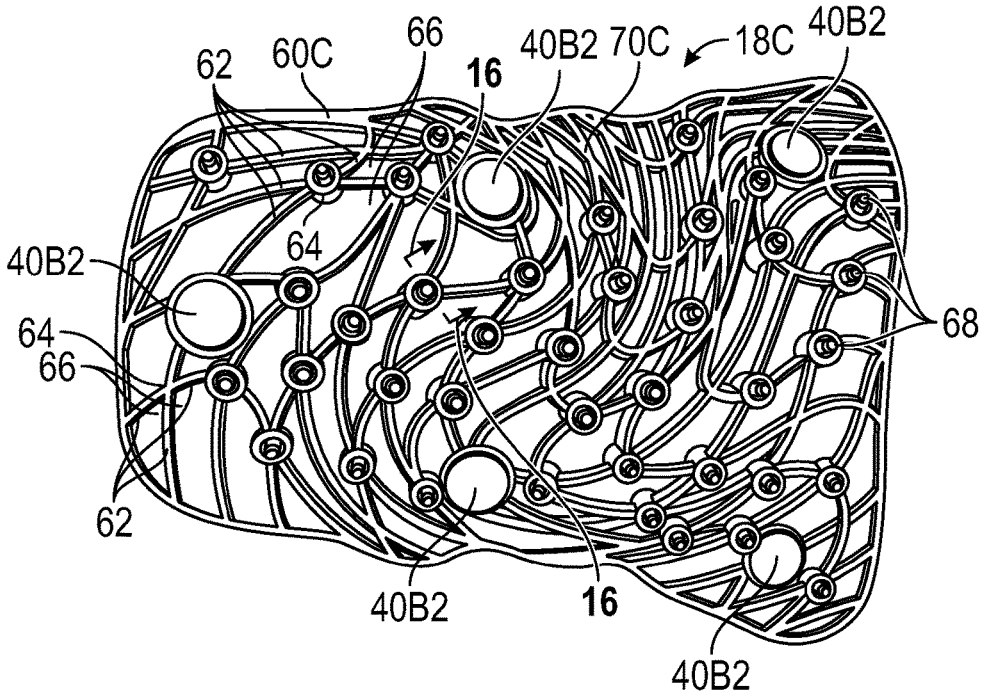
FIG. 8 is a plan view of a throat ornamentation for the throat region of the article of footwear.

FIG. 16 is a fragmentary cross-sectional view of the throat ornamentation 18C of FIG. 8 taken at lines 16-16. The embellishment 68 is disposed at one of the nodes 64 of the webbed base 60C. The embellishment 68 is adhered or otherwise secured to a mount 90 with a threaded extension 92 received in an internally threaded backing 94 fit to the webbed base 60C at a through hole 96 in the node 64. A flange 97 of the backing 94 is relatively thin (e.g., in comparison to the mount 90) to enable the inner side of the throat ornamentation 18C to more closely contour to (e.g., follow the shape of) the outer surface 46 of the upper 14.

Figure 17:
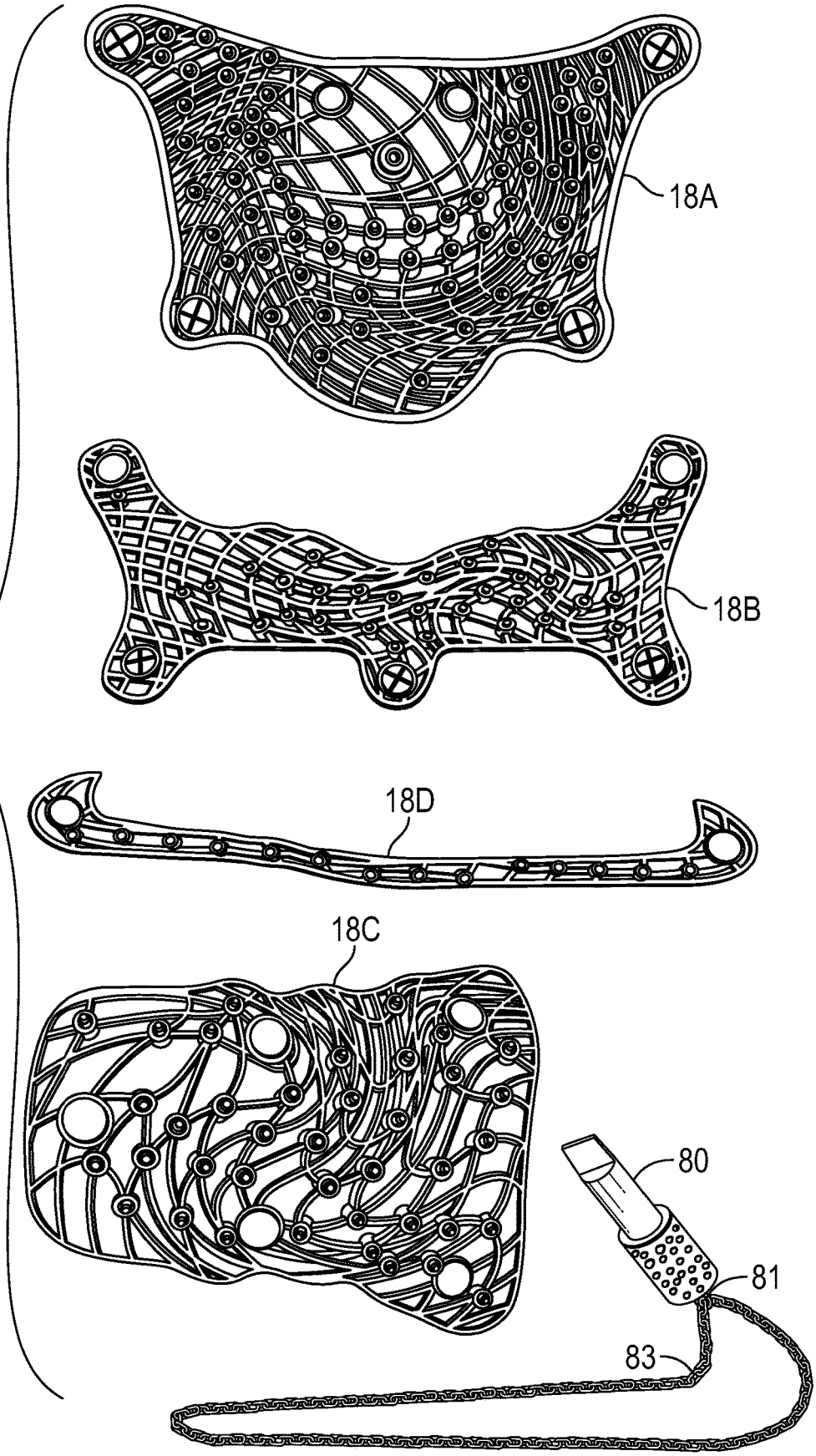
FIG. 17 is a plan view of an accessory kit for the article of footwear of FIG. 1.
Figure 18:
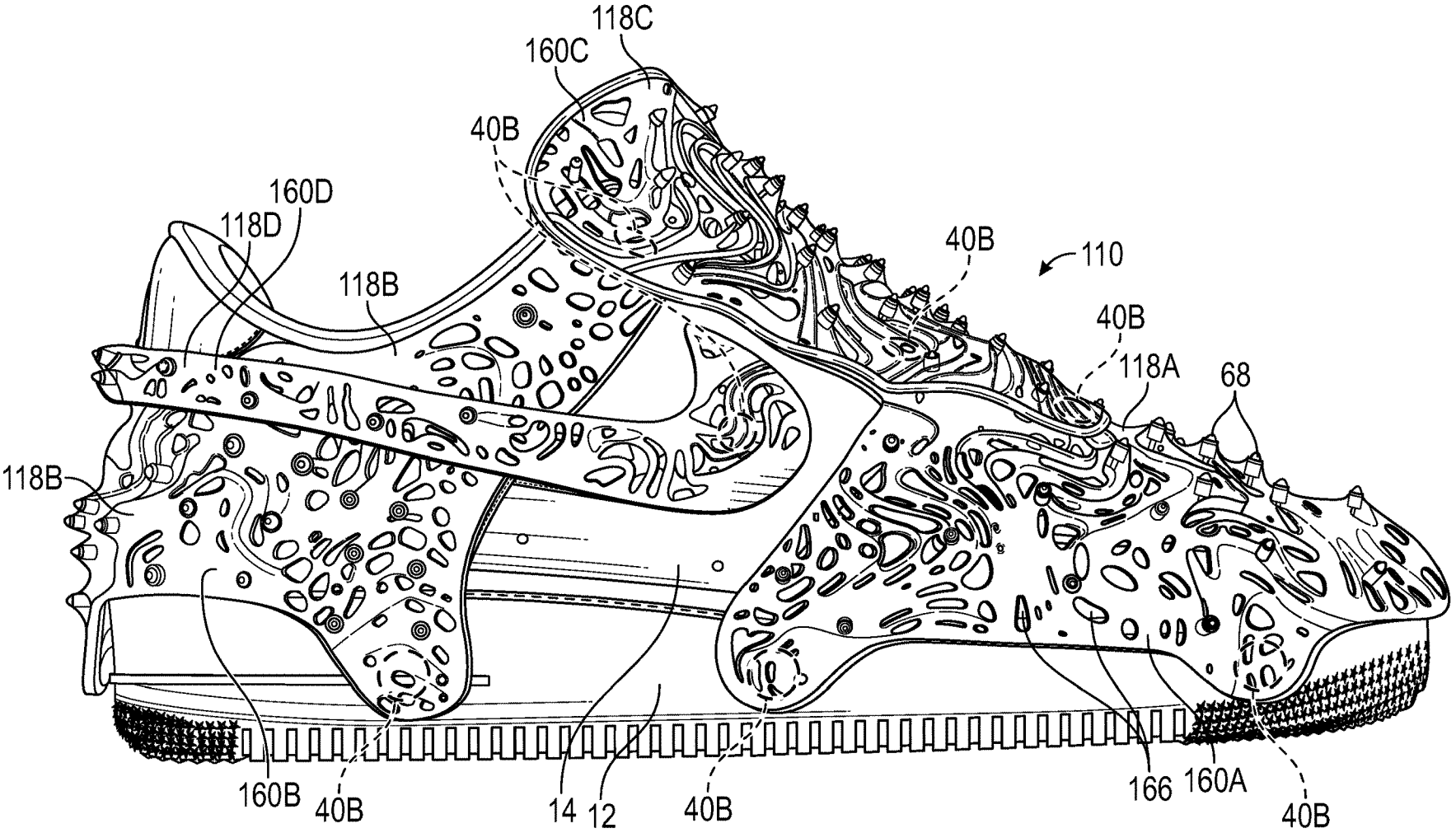
FIG. 18 is a lateral side view of the article of footwear of FIG. 2 including ornamentations of a second accessory system.

FIG. 17 shows the ornamentations 18A-18D and the tool 80 grouped as an accessory kit 100 that may be packaged with the footwear 10 shown in FIG. 3. Alternatively, the footwear 10 may be sold with the ornamentations 18A-18C mounted thereon, and the ornamentations 18A-18D of the accessory kit 100 may include ornamentations of a different color, shape, etc. than those mounted on the footwear 10 at the time of purchase. A purchaser may thus purchase the accessory kit 100 to enable even more aesthetic appearances or functions of the footwear 10. The purchaser may choose to secure any or all of the ornamentations 18A-18D to the upper 14 and/or the sole structure 12. For example, FIG. 18 shows an article of footwear 110 with the same upper 14 and sole structure 12 as the footwear 10, but having ornamentations 118A, 118B, 118C, 118D similar in shape and size to the corresponding ornamentations 18A, 18B, 18C, 18D and having second fastener components arranged in a second spatial arrangement that matches that of the ornamentations 18A-18D so that the ornamentations 118A-118D can be releasably secured to the upper 14 and/or sole structure 12 as shown in FIG. 18 while following the contoured outer surfaces 42, 44, 46, 48, and 50 of the upper 14. In FIG. 17, the second fastener components 40B are all of the magnetic type as described in FIG. 14 but without the flange 89 (e.g., they are secured to the inner sides of the ornamentations 118A-118D with adhesive or otherwise but do not extend at the outer sides of the ornamentations 118A-118D) so that the second fastener components 40B are not readily viewed from the exterior of the article of footwear 110. The ornamentations 118A-118D have webbed bases 160A, 160B, 160C, and 160D, respectively, with embellishments 68. The webbed bases 160A-160D have openings 166 for flexibility and the ability to adapt from a flat state to a contoured shape that follows the contoured outer surfaces of the upper 14 and the sole structure 12. Although the ornamentations 18A-18D and 118A-118D are shown in the figures as mainly decorative, the ornamentations 18A-18D and 118A-118D may provide useful functional aspects when secured to the footwear 10, 110, such as ball control, coefficients of friction configured to affect use, etc.

Figure 19:
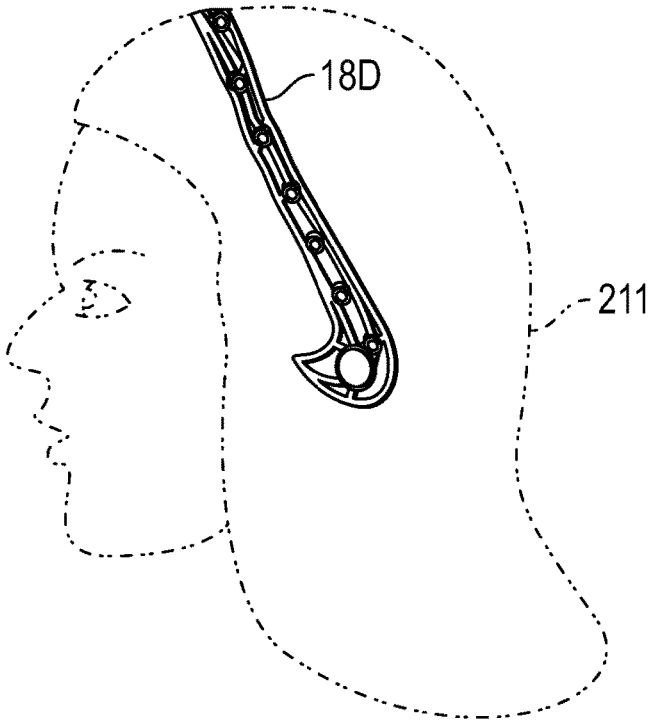
FIG. 19 is a side view of the side ornamentation of FIG. 9 worn as a headband.
Figure 20:
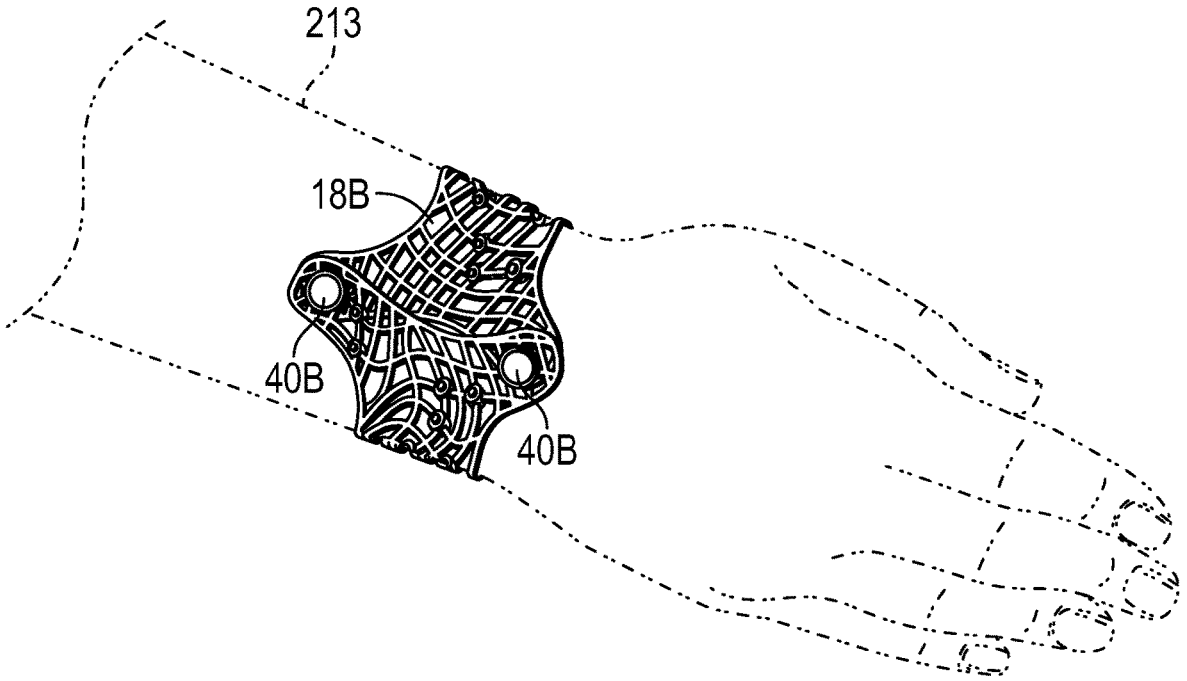
FIG. 20 is a perspective illustration of the heel ornamentation of FIG. 7 worn as a bracelet.

Because each ornamentation 18A-18D is flexible to adapt from a relatively flat state when off of the upper 14 (e.g., when not secured to the upper by the fastener components) and sole structure 12 to the contoured shape of the outer surfaces of the upper 14 when secured to one or both of the upper 14 or the sole structure 12, the ornamentations 18A-18D may also have decorative and/or functional uses other than as ornamentations for footwear 10 or 110. For example, the ornamentation may be configured to be worn as jewelry or as a hair accessory when removed from the upper and sole structure. As shown in FIG. 19, the side ornamentation 18D is shown worn as a headband on the head 211 of a wearer. The ornamentation 18D may be tucked into the hair or behind the ears or may be pinned such as with bobby pins. FIG. 20 shows the heel ornamentation 18B worn as a bracelet wrapped around a wrist 213 of the wearer with the magnetic fasteners 40B from the opposite medial and lateral sides of the ornamentation 18B configured to attract to one another to secure the ornamentation 18B in a loop around the wrist 213. The owner of the footwear 10 may decide to adorn the footwear 10 with some or all of the ornamentation 18A-18D on some occasions and may decide to remove some or all of the ornamentations from the footwear 10 on other occasions, in which case they could be worn as shown in FIGS. 19 and 20 or otherwise. In another example, the ornamentations 18A-18D or 118A-118D can be secured to a purse or other carry bag or to apparel when not secured to the article of footwear 10 or 110.

Figure 21:
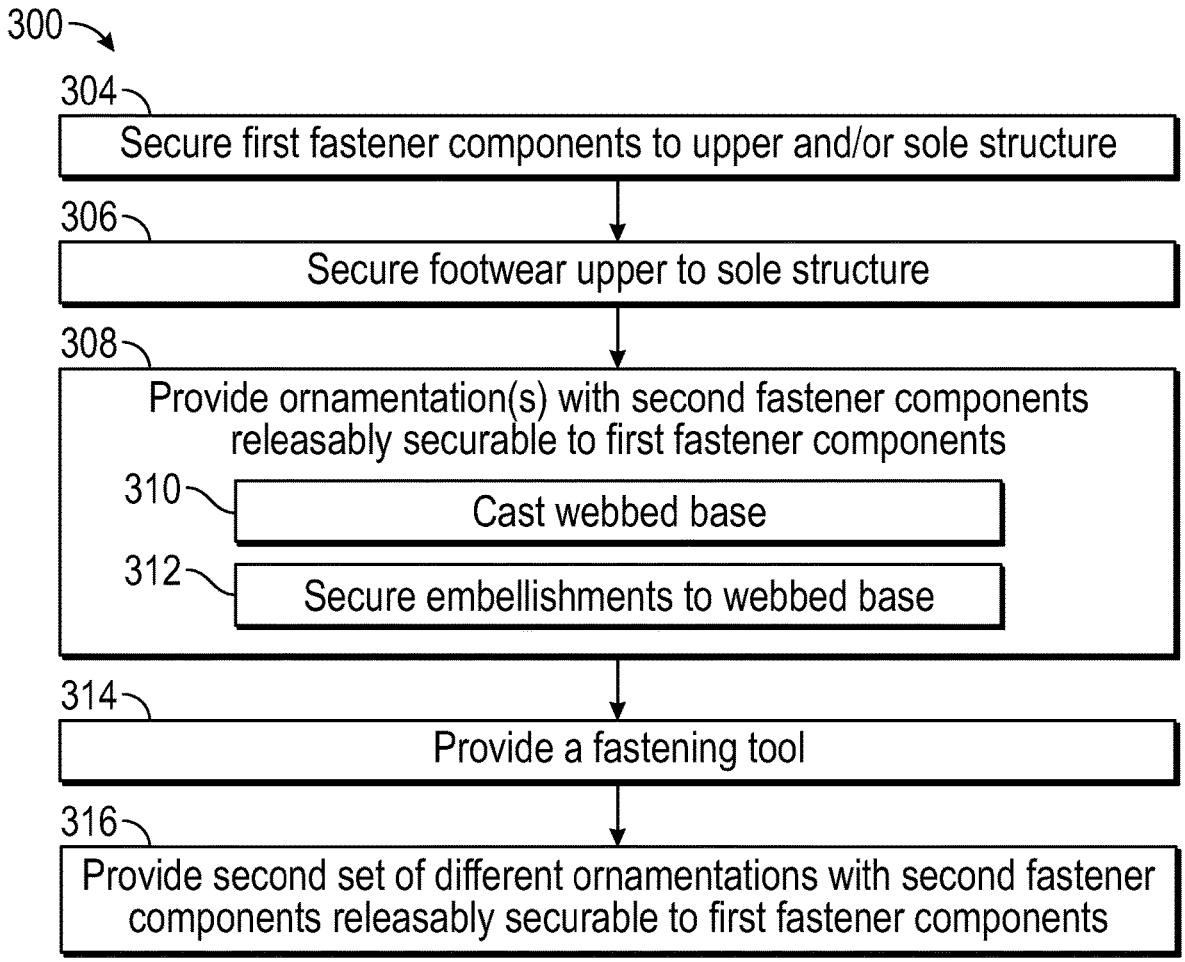
FIG. 21 is a flow diagram of a method of manufacturing an article of footwear such as the article of footwear of FIG. 1.

FIG. 21 is a flow diagram of a method 300 of manufacturing an article of footwear 10 or 110 shown herein. The method 300 may start at 302 and proceed to step 304, securing a plurality of first fastener components 40A to at least one of a footwear upper 14 or a sole structure 12 so that the first fastener components 40A are arranged in a first spatial arrangement. The method 300 may also include step 306, securing the footwear upper 14 to the sole structure 12. Step 306 may occur prior to or after step 304. In some implementations, step 306 is not included in the method as a different entity than the entity carrying out step 304 may secure the upper to the sole structure. The method 300 may include step 308, providing at least one ornamentation 18A-18D with a plurality of second fastener components 40B configured to secure to the first fastener components 40A. The plurality of second fastener components 40B are arranged in a second spatial arrangement as discussed herein. The ornamentations 18A-18D may be configured to flex from a relatively flat shape (see, e.g., FIG. 6-9) to a contoured shape (see. e.g., FIGS. 1-2) when secured to one or both of the sole structure 12 or the upper 14, with the second spatial arrangement matching the first spatial arrangement and the contoured shape of the at least one ornamentation 18A-18D following the contoured outer surface of the upper 14.

As shown in FIGS. 1 and 2, the at least one ornamentation 18A-18D may include a webbed base 60A-60D with a plurality of strands 62 interconnected connected at nodes 64. Step 308 of the method 300 may include sub-step 310, casting the webbed base 60A-60D from a castable polyurethane. Step 308 may further include sub-step 312, securing embellishments 68 to the webbed base (any of webbed base 60A-60D) at the nodes 64 so that the embellishments 68 are exposed at an outer side of the webbed base 60A-60D. Alternatively, either or both of sub-steps 310 and 312 may be performed by a separate entity than the entity providing the ornamentations in step 308.

Additionally, providing the at least one ornamentation under the method 300 may include offering the ornamentations 18A-18D as a kit such as the accessory kit 100 of FIG. 17. The method 300 may further include step 314, providing a tool 80 configured to fasten the second fastener components 40B to the first fastener components 40A, for example as a part of the accessory kit 100. Additionally, the at least one ornamentation 18A-18D may be a first set of ornamentations, and the method 300 may further include step 316, providing a second set of ornamentations 118A-118D having second fastener components 40B arranged in the second spatial arrangement and configured to removably secure to the first fastener components 40A to secure the second set of ornamentations 118A-118D to the upper 14 or the sole structure 12 wherein the second set of ornamentations 118A-118D is different in at least one of a color, shape, or embellishments than the first set of ornamentations 18A-18D. For example, the accessory kit 100 may include both the first and second sets of ornamentations 18A-18D and 118A-118D or 218A, or the first and second sets of ornamentations may be made available to a consumer for purchase separately, as different kits to adorn the footwear 10.

Accordingly, the configuration of the footwear 10 or 110 and the accessory system 16 with ornamentations 18A-18D or 118A-118D enables a wearer to obtain many different looks from just one article of footwear. When the ornamentations are not secured to the upper 14 and/or sole structure 12, the footwear 10 or 110 may be better suited for athletic use. When one or more of the ornamentations 18A-18D, 118A-118D, or 218A are secured to the upper 14 and/or the sole structure 12, the footwear 10 or 110 may be better suited for leisure activities.

The following Clauses provide example configurations of an article of footwear, an accessory kit for an article of footwear, and a method of manufacturing an article of footwear as disclosed herein.

Clause 1: An article of footwear comprising: an upper and a sole structure secured to the upper; and an accessory system including at least one ornamentation selectively securable to and removable from one or both of the sole structure or the upper, the at least one ornamentation partially covering a contoured outer surface of the upper when secured to the article of footwear; wherein the at least one ornamentation flexes from a relatively flat shape to a contoured shape when secured to one or both of the sole structure or the upper, the contoured shape following the contoured outer surface of the upper.

Clause 2: The article of footwear of clause 1, wherein the at least one ornamentation includes a webbed base.

Clause 3: The article of footwear of clause 2, wherein: the webbed base includes a plurality of strands interconnected at nodes; and the ornamentation further includes embellishments secured to the webbed base at the nodes and exposed at an outer side of the webbed base.

Clause 4: The article of footwear of clause 3, wherein the embellishments are beads.

Clause 5: The article of footwear of any of clauses 3-4, wherein the embellishments comprise crystal, glass, or plastic.

Clause 6: The article of footwear of any of clauses 2-5, wherein the webbed base comprises a castable polyurethane.

Clause 7: The article of footwear of any of clauses 1-6, wherein the accessory system includes a plurality of fasteners, the fasteners including first fastener components fixed to one or both of the sole structure or the upper and second fastener components fixed to the at least one ornamentation and configured to secure to the first fastener components to secure the at least one ornamentation to one or both of the sole structure or the upper.

Clause 8: The article of footwear of clause 7, wherein: the first fastener components are arranged in a first spatial arrangement on the sole structure and the upper; and the second fastener components are arranged in a second spatial arrangement on the at least one ornamentation, the second spatial arrangement matching the first spatial arrangement when the at least one ornamentation is disposed on the contoured outer surface of the upper.

Clause 9: The article of footwear of any of clauses 7-8, wherein a first set of the first fastener components are fixed to the sole structure and a second set of the first fastener components are fixed to the upper.

Clause 10: The article of footwear of any of clauses 7-9, wherein a first group of the fasteners are magnetic fasteners or snaps and a second group of the fasteners are threaded fasteners.

Clause 11: The article of footwear of clause 10, wherein the upper defines a foot opening and at least one of the fasteners of the first group is secured to the upper along the foot opening.

Clause 12: The article of footwear of any of clauses 7-11, wherein the accessory system further includes a tool configured to fasten the second fastener components to the first fastener components.

Clause 13: The article of footwear of any of clauses 1-12, wherein the at least one ornamentation wraps from a medial side to a lateral side of the upper when secured to the upper or the sole structure.

Clause 14: The article of footwear of any of clauses 1-13, wherein the at least one ornamentation includes multiple ornamentations each selectively securable to and removable from one or both of the sole structure or the upper independently of one another, each partially covering a different respective contoured outer surface of the upper when secured to one or both of the sole structure or the upper, and at least some of the ornamentations having different shapes.

Clause 15: The article of footwear of clause 14, wherein each of the ornamentations includes a webbed base, the webbed base of at least one of the ornamentations overlapping the webbed base of at least one other of the ornamentations when the ornamentations are secured to one or both of the sole structure or the upper.

Clause 16: The article of footwear of any of clauses 1-15, wherein the at least one ornamentation is configured to be worn as a bracelet or a headband when removed from one or both of the sole structure or the upper.

Clause 17: An accessory kit for an article of footwear, the accessory kit comprising: at least one ornamentation selectively securable to and removable from the article of footwear, the at least one ornamentation partially covering a contoured outer surface of an upper of the article of footwear when secured to the article of footwear; wherein the at least one ornamentation flexes from a relatively flat shape to a contoured shape when secured to the article of footwear, the contoured shape following the contoured outer surface of the upper.

Clause 18: The accessory kit of clause 17, further comprising: a tool configured to secure the at least one ornamentation to the article of footwear.

Clause 19: The accessory kit of any of clauses 17-18, wherein the at least one ornamentation includes multiple different ornamentations each selectively securable to and removable from the article of footwear independently of one another, each partially covering a different respective contoured outer surface of the upper when secured to the article of footwear, and at least some of the multiple different ornamentations having a different shape.

Clause 20: The accessory kit of clause 19, wherein each of the multiple different ornamentations includes: a webbed base including a plurality of strands interconnected at nodes; and embellishments secured to the webbed base at the nodes and exposed at an outer side of the webbed base.

Clause 21: A method of manufacturing an article of footwear, the method comprising: providing an accessory system including at least one ornamentation selectively securable to and removable from one or both of a sole structure or an upper secured to the sole structure, the at least one ornamentation partially covering a contoured outer surface of the upper when secured to the article of footwear; wherein the at least one ornamentation flexes from a relatively flat shape to a contoured shape when secured to one or both of the sole structure or the upper, the contoured shape following the contoured outer surface of the upper.

Clause 22: The method of clause 21, wherein first fastener components are arranged in a first spatial arrangement on one or both of a sole structure or a footwear upper, and the method further comprising: securing a plurality of second fastener components to the at least one ornamentation so that the second fastener components are arranged in a second spatial arrangement matching the first spatial arrangement, the second fastener components configured to removably secure to the first fastener components.

Clause 23: The method of clause 22, further comprising: securing the first fastener components to at least one of the footwear upper or the sole structure so that the first fastener components are arranged in the first spatial arrangement.

Clause 24: The method of any of clauses 22-23, further comprising providing a tool configured to fasten the second fastener components to the first fastener components.

Clause 25: The method of any of clauses 22-24, wherein the at least one ornamentation is a first set of ornamentations, and the method further comprising: providing a second set of ornamentations having second fastener components arranged in the second spatial arrangement and configured to removably secure to the first fastener components to secure the second set of ornamentations to the footwear upper or the sole structure; wherein the second set of ornamentations is different in at least one of a color, shape, or embellishments than the first set of ornamentations.

Clause 26: The method of any of clauses 21-25, wherein the at least one ornamentation includes a webbed base with a plurality of strands interconnected at nodes; and the method further comprising: securing embellishments to the webbed base at the nodes so that the embellishments are exposed at an outer side of the webbed base.

Clause 27: The method of clause 26, further comprising casting the webbed base from a castable polyurethane.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper and a sole structure secured to the upper; and an accessory system including at least one ornamentation selectively securable to and removable from one or both of the sole structure or the upper, the at least one ornamentation partially covering a contoured outer surface of the upper when secured to the article of footwear;

wherein the at least one ornamentation is configured to flex from a first shape to a contoured shape when secured to one or both of the sole structure or the upper, the first shape being relatively flat as compared to the contoured shape and the contoured shape following the contoured outer surface of the upper;

wherein the accessory system includes a plurality of fasteners, the fasteners including first fastener components and second fastener components, the first fastener components fixed directly to one or both of the sole structure or the upper and the second fastener components fixed to and extending through the at least one ornamentation and configured to fasten to the first fastener components to secure the at least one ornamentation to one or both of the sole structure or the upper; and wherein the at least one ornamentation includes multiple ornamentations, each of the multiple ornamentations selectively securable to and removable from one or both of the sole structure or the upper independently of one another without securing or removing any other of the multiple ornamentations from the one or both of the sole structure or the upper, each partially covering a different respective contoured outer surface of the upper when secured to one or both of the sole structure or the upper, and at least some of the multiple ornamentations having different shapes.

2. The article of footwear of claim 1, wherein the at least one ornamentation includes a webbed base.

3. The article of footwear of claim 2, wherein:

the webbed base includes a plurality of strands interconnected at nodes; and the at least one ornamentation further includes embellishments secured to the webbed base at the nodes and exposed at an outer side of the webbed base.

4. The article of footwear of claim 1, wherein:

the first fastener components are arranged in a first spatial arrangement on the sole structure and the upper; and the second fastener components are arranged in a second spatial arrangement on the at least one ornamentation, the second spatial arrangement matching the first spatial arrangement when the at least one ornamentation is disposed on the contoured outer surface of the upper.

5. The article of footwear of claim 1, wherein a first set of the first fastener components are fixed directly to the sole structure and a second set of the first fastener components are fixed directly to the upper.

6. The article of footwear of claim 1, wherein a first group of the fasteners includes magnetic fasteners or snaps and a second group of the fasteners includes threaded fasteners.

7. The article of footwear of claim 1, wherein the at least one ornamentation wraps from a medial side to a lateral side of the upper when secured to the upper or the sole structure.

8. The article of footwear of claim 1, wherein each of the multiple ornamentations includes a webbed base, the webbed base of at least one of the multiple ornamentations overlapping the webbed base of at least one other of the multiple ornamentations when the multiple ornamentations are secured to one or both of the sole structure or the upper.

9. An accessory kit for an article of footwear, the accessory kit comprising:

at least one ornamentation selectively directly securable to and removable from at least one of an upper or a sole structure of the article of footwear by a fastener component extending through the at least one ornamentation, the at least one ornamentation partially covering a contoured outer surface of the upper of the article of footwear when secured to the article of footwear;

wherein the at least one ornamentation is configured to flex from a first shape to a contoured shape when secured to the article of footwear, the first shape being relatively flat as compared to the contoured shape and the contoured shape following the contoured outer surface of the upper; and wherein the at least one ornamentation includes multiple different ornamentations each selectively securable to and removable from the article of footwear independently of one another without securing or removing any other of the multiple different ornamentations from the one or both of the sole structure or the upper, each partially covering a different respective contoured outer surface of the upper when secured to the article of footwear, and at least some of the multiple different ornamentations having a different shape.

10. The accessory kit of claim 9, further comprising:

a tool configured to secure the at least one ornamentation to the article of footwear.

11. The accessory kit of claim 9, wherein each of the multiple different ornamentations includes:

a webbed base including a plurality of strands interconnected at nodes; and embellishments secured to the webbed base at the nodes and exposed at an outer side of the webbed base.

12. An article of footwear comprising:

an upper and a sole structure secured to the upper; and an accessory system including at least one ornamentation selectively securable to and removable from one or both of the sole structure or the upper, the at least one ornamentation partially covering a contoured outer surface of the upper when secured to the article of footwear;

wherein the at least one ornamentation is configured to flex from a first shape to a contoured shape when secured to one or both of the sole structure or the upper, the first shape being relatively flat as compared to the contoured shape and the contoured shape following the contoured outer surface of the upper;

wherein the accessory system includes a plurality of fasteners, the fasteners including first fastener components and second fastener components, the first fastener components fixed directly to one or both of the sole structure or the upper and the second fastener components fixed to and extending through the at least one ornamentation and configured to fasten to the first fastener components to secure the at least one ornamentation to one or both of the sole structure or the upper; and wherein a first set of the first fastener components are fixed directly to the sole structure and a second set of the first fastener components are fixed directly to the upper.

13. The article of footwear of claim 12, wherein the at least one ornamentation includes a webbed base.

14. The article of footwear of claim 13, wherein:

the webbed base includes a plurality of strands interconnected at nodes; and the at least one ornamentation further includes embellishments secured to the webbed base at the nodes and exposed at an outer side of the webbed base.

15. The article of footwear of claim 12, wherein:

the first fastener components are arranged in a first spatial arrangement on the sole structure and the upper; and the second fastener components are arranged in a second spatial arrangement on the at least one ornamentation, the second spatial arrangement matching the first spatial arrangement when the at least one ornamentation is disposed on the contoured outer surface of the upper.

16. The article of footwear of claim 12, wherein a first group of the fasteners includes magnetic fasteners or snaps and a second group of the fasteners includes threaded fasteners.

17. The article of footwear of claim 12, wherein the at least one ornamentation wraps from a medial side to a lateral side of the upper when secured to the upper or the sole structure.

18. The article of footwear of claim 12, wherein the at least one ornamentation includes multiple ornamentations, each of the multiple ornamentations selectively securable to and removable from one or both of the sole structure or the upper independently of one another without securing or removing any other of the multiple ornamentations from the one or both of the sole structure or the upper, each partially covering a different respective contoured outer surface of the upper when secured to one or both of the sole structure or the upper, and at least some of the multiple ornamentations having different shapes.

19. The article of footwear of claim 18, wherein each of the multiple ornamentations includes a webbed base, the webbed base of at least one of the multiple ornamentations overlapping the webbed base of at least one other of the multiple ornamentations when the multiple ornamentations are secured to one or both of the sole structure or the upper.

* * * * *